US005241219A

United States Patent [19]

LeBaron et al.

[11] Patent Number: 5,241,219

[45] Date of Patent: Aug. 31, 1993

[54] CURRENT MODE COUPLER

[75] Inventors: James B. LeBaron, Sidney; David O. Gallusser; Brian R. Hackler, both of Oneonta, all of N.Y.

[73] Assignee: Amphenol Corporation, Wallingford, Conn.

[21] Appl. No.: 804,696

[22] Filed: Dec. 11, 1991

[51] Int. Cl.[5] ..... H01F 13/00

[52] U.S. Cl. ..... 307/104; 336/DIG. 2

[58] Field of Search ..... 307/104; 336/DIG. 2; 361/331, 380, 392, 428

[56] References Cited

U.S. PATENT DOCUMENTS

| | | | |
|---|---|---|---|
| 3,742,408 | 6/1973 | Jaeger . | |
| 4,264,827 | 4/1981 | Herzog | 307/17 |
| 4,904,879 | 2/1990 | Rudy et al. . | |
| 5,070,293 | 12/1991 | Ishii et al. | 320/2 |
| 5,081,648 | 1/1992 | Herzog | 375/36 |

OTHER PUBLICATIONS

AEEC publication "AEEC Letter 87-122/SAI-313", Sep. 17, 1987, pp. 1, 38-44, Aeronautical Radio, Inc.

*Primary Examiner*—Jeffrey A. Gaffin

*Attorney, Agent, or Firm*—Bacon & Thomas

[57] ABSTRACT

A current mode coupler for an unshielded twisted-pair cable includes an elastomeric signal wire and E-core positioning member with integral strain relief, tapered E-cores for improved coupling to the wires, a write signal core which is twice the size of the read signal core, an all metal core suspension, an overcenter spring biased mounting arrangement, a metal enclosure for improved shielding, a resilient latch which avoids the need for pivoting of an upper housing member relative to the base unit during assembly, and contoured edges and corners for reducing heat accumulation.

80 Claims, 4 Drawing Sheets

CURRENT MODE COUPLER

BACKGROUND OF THE INVENTION

1. Field of the Invention

This invention relates to the field of electrical connectors, and in particular to a current-mode coupler capable of non-invasively transferring electronic data signals to and from a twisted pair cable.

2. Description of Related Art

Couplers for sensing the transmission of low-level signal currents through an electrical conductor without an electrical connection to the conductor, thereby eliminating the need for direct wiring into the bus cable, have recently been developed for use in environments such as aircraft in which replaceable couplings, for example of black boxes and other electronic control units with a single closed loop data bus, are required.

The present invention is an improvement on the coupler disclosed in U.S. Pat. No. 4,904,879. The device disclosed in U.S. Pat. No. 4,904,879 is a coupler assembly for establishing a non-invasive coupling to the conductor wires of a twisted pair data bus cable in which mating pairs of E-shaped electromagnets are arranged to define a pair of electromagnetic cores having windings about central legs thereof which are electrically connected to a control unit for sensing and transmitting signals along the data bus. The coupler assembly of U.S. Pat. No. 4,904,879, designed for use in aircraft, includes an upper half and a lower half connected together by a pivot at one end and a quarter turn latch at the other. The lower E-cores are molded into an insulating unit, which is coated with elastomeric material both between the cores and external to the cores for respectively holding the wires in place and providing a biasing force to ensure that the upper and lower E-cores mate properly without an air gap. A circuit board module in the pivotal upper half of the coupler assembly is separately shielded by a metallic housing which is soldered onto the circuit board substrate. Assembly is accomplished by bolting the lower half to a frame, inserting the data bus cable wires, and pivoting the upper half to cause the E-cores to mate with each other.

Although this type of current mode coupler possibly presents an improvement over prior devices, a number of disadvantages remain. These include inadequate coupling between the E-cores and the data bus cable wires, a higher than optimum write winding current requirement, and the tendency of the elastomeric core suspension to deteriorate over time, resulting in formation of an air gap and thereby increasing the reactance of the core structure. In addition, the simple bolt and nut mounting arrangement used for mounting the lower half of conventional non-invasive data bus couplers to a panel, and the relatively complex pivoting structure required to attach the upper coupler half to the lower half present problems in situations where the coupler is to be mounted in a relatively inaccessible area. The fact that the prior coupler provides no arrangement for shielding the core assembly could also present problems, although the signal amplifiers themselves are shielded. Finally, the coupler of U.S. Pat. No. 4,904,879, due to its high current requirements and geometric design, may be subject to overheating.

Therefore, even though the desirability of the basic concept of the non-invasive data current has previously been recognized, an optimal arrangement from the standpoint of both operational life and convenience has yet to be achieved.

SUMMARY OF THE INVENTION

In view of the disadvantages of prior non-invasive current-mode couplers, the current-mode coupler of the invention has been designed to meet the following objectives:

1. to provide improved electrical coupling between the signal wires of a twisted pair cable and a magnetic E-core structure, including the provision of an improved cable strain relief;
2. to reduce the current requirements of the write signal winding;
3. to provide a core suspension which does not deteriorate over time;
4. to provide an improved coupler base unit mounting arrangement which provides rapid mounting and removal of the coupler even in areas where the panel to which the coupler is to be mounted is accessible from only one side;
5. to provide an improved arrangement for securing an upper half of the coupler to its lower half, which does not require pivoting of the upper half with respect to the lower half thereby further reducing the time and manual dexterity required for in situ assembly of the coupler;
6. to provide improved electrical shielding for the E-core structure as well as for the signal processing electronics of the coupler;
7. to provide improved heat dissipation and reduce the possibility of overheating; and
8. to generally reduce the number of components and thereby decrease the cost and simplify the process of manufacturing the coupler without sacrificing efficiency or reliability.

These objectives are accomplished by providing, in accordance with the principles of a preferred embodiment of the invention, a current-mode coupler of the type intended to be used with a closed loop twisted pair data bus cable, the wires of the cable being held in position relative to two pairs of E-cores forming a core structure for inductively transferring data signals to and from a printed circuit signal winding, wherein:

electrical coupling between the signal wires of a twisted pair cable and a magnetic E-core is improved by providing a discrete elastomeric signal wire guide structure, including an integral wire strain relief and upper and lower core positioning and retaining surfaces, thereby eliminating the need to encapsulate the core structure, the electrical coupling being further improved by tapering the cores to conform to the geometry of the wires in the guide;

current requirements for the write-signal winding are reduced by providing a write core which is substantially larger than the read core;

the tendency of elastomeric core suspensions to set over time is avoided by providing a unique all-metal core suspension which utilizes a plurality of discrete coil springs attached to a dielectric lower core holder;

mounting of the base unit of the coupler to a panel or bulkhead is achieved by providing a self-centering mounting arrangement in which locking and unlocking is achieved by a sliding locking member actuated by a lever and held in both the locking and unlocking positions by a pair of overcenter bias springs;

assembly of the upper half of the coupler to the lower half base unit is achieved by snapping an integral latching member provided at one end of either the upper or lower half of the coupler into a slot or recess provided in the corresponding other half of the coupler, the latching member being resilient to permit the upper half to be fitted onto the lower half in a single motion directed transversely to the plane of the panel onto which the coupler is to be mounted, without the need to first secure the upper half to a pivot assembly provided on the lower half;

shielding is provided by a conductive metal housing which encloses the entire coupler, including the E-core structure, when the coupler is assembled;

all edges of the coupler are contoured to prevent the heat accumulation which tends to occur at sharp corners of heat conductive structures; and all edges of the E-cores are also contoured to prevent heat accumulation.

DETAILED DESCRIPTION OF THE PREFERRED EMBODIMENT

Figure 1:
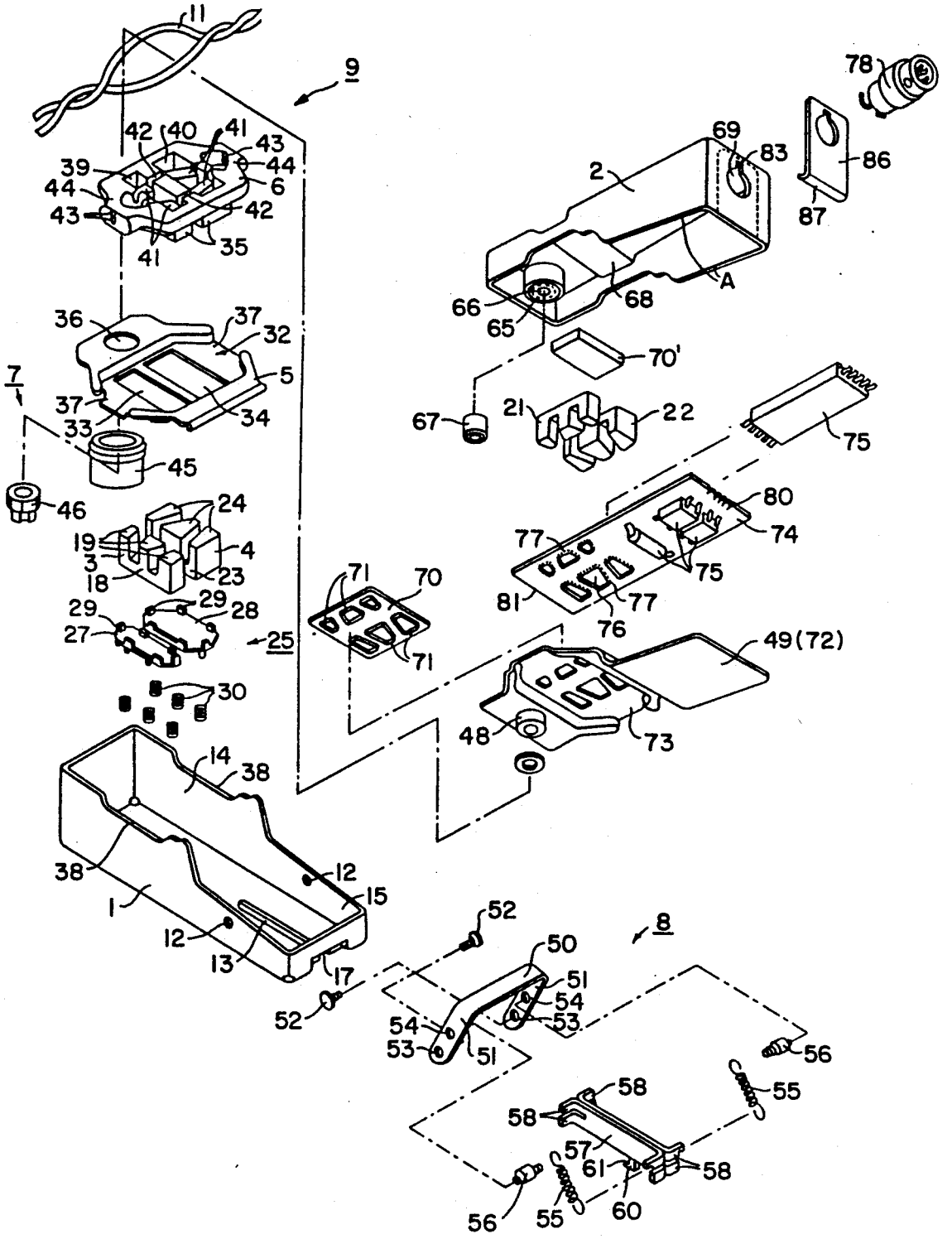
FIG. 1 is an exploded perspective view of the constituent components of a current mode coupler according to a preferred embodiment of the invention.
Figure 2:
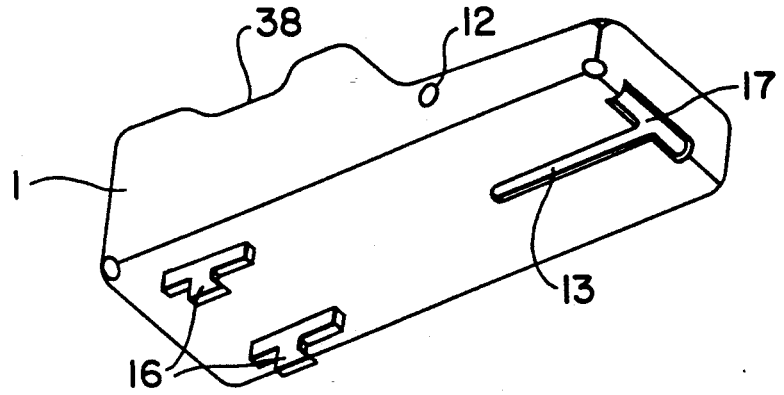
FIG. 2 is a perspective view of the base of the lower shield cover of the current mode coupler of FIG. 1.
Figure 3:
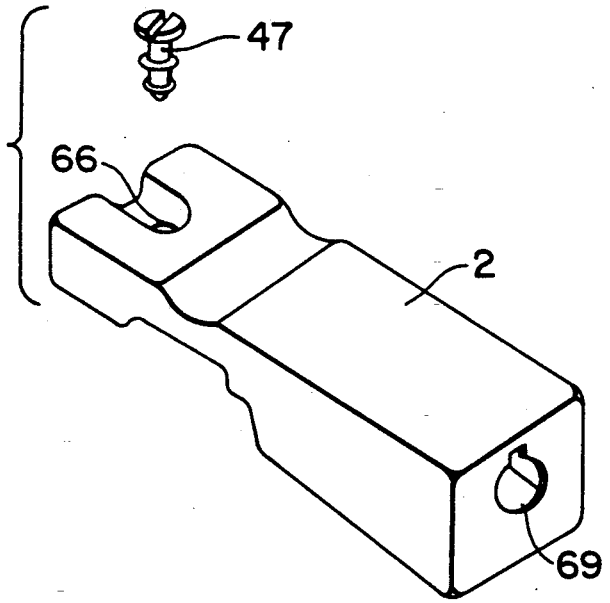
FIG. 3 is a perspective view of the top of the upper shield housing for the preferred coupler of FIG. 1.

As illustrated in FIGS. 1–3, a current mode coupler constructed in accordance with the principles of a preferred embodiment of the invention includes a shield housing made up of a lower housing member 1 and an upper housing member 2. Mounted within the lower housing member 1 are a pair of E-cores 3 and 4; a wire guide holder 5; an elastomeric wire guide, strain relief, and core alignment member 6; a quarter-turn latch receptacle assembly 7; and a panel mounting and locking mechanism 8. Each of elements 2–8 are secured in the lower housing member 1 to form a base unit 9 for mounting the coupler to a panel, bulkhead, or other surface (element 10, shown in FIG. 4) adjacent unshielded twisted pair data bus cable 11.

In order to provide shielding for the entire coupler, and to minimize weight and simplify assembly, housing members 1 and 2 are preferably formed of a conductive metal having good elongation to facilitate stamping, although it is within the scope of the invention to substitute conductively coated molded thermoplastic housing members. Suitable materials for the preferred metal housing members include aluminum, copper, or steel, aluminum being especially advantageous because of its light weight and conductivity.

Included in cover 1 are apertures 12 to which a mounting mechanism pivot is secured, a slot 13 for accommodating a mounting mechanism sliding foot member, an E-core mounting chamber 14, and a mounting mechanism accommodating chamber 15. The lower surface of housing member 1 preferably includes metal foot members 16, formed for example of aluminum and brazed onto the base member. The foot members cooperate with the mounting mechanism sliding foot member to center and secure the lower housing member in place on a panel, as described in detail below. As illustrated, both the upper and lower housing members 1 and 2 are formed with contoured edges to prevent the heat accumulation which would otherwise occur because heat tends to concentrate at shape corners. A slot or recess 17 at one end of the lower housing member 1 cooperates with a resilient latching member on upper housing member 2 to permit the upper and lower housing members to be assembled together in a non-pivotal manner, also described in detail below.

E-core 3 is made of a magnetically permeable material such as iron, and includes a base 18 and three leg members 19. E-core 3 cooperates with an upper E-core 21 to form a signal reception core structure or read transformer for receiving signals from one of the bus wires, while E-core 4 cooperates with an upper E-core 22 to form a write core structure or transformer for transmitting signals to the other of the bus wires, and also includes a base 23 and three legs 24.

Figure 7A:
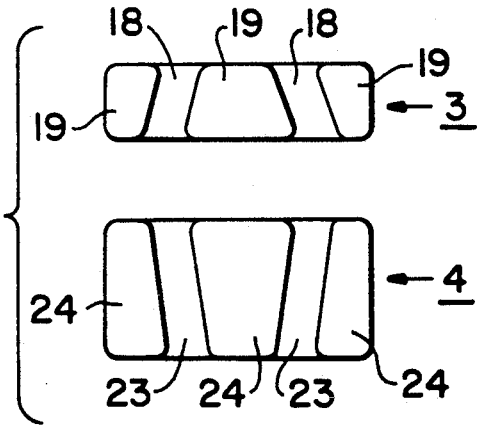
FIG. 7*a* is an elevated top view of a pair of contoured E-cores suitable for use with the coupler of FIGS. 1–5.
Figure 7B:
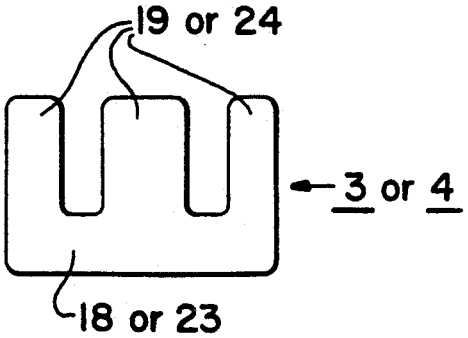
FIG. 7*b* is an elevated side view of one of the E-cores of FIG. 7*a*.

E-cores 3 and 4 include three especially advantages features, best shown in FIGS. 7*a* and 7*b*. The first is that transmit or write core 4 has approximately twice the cross-sectional area of reception core 3 in order to minimize the required driving current, thereby increasing the efficiency of the device and reducing the generation of heat. The second advantageous feature is that the leg members of each core have trapezoidal cross sections, providing a taper or contour shape which matches the lay of an untwisted bus wire pair when seated in the elastomeric wire guide, as will become more apparent from the description of the wire guide. Thus the gap between the respective cores and wires is maintained at a constant minimum value, maximizing the inductive coupling between the wires and the core. The third advantageous feature is the rounded corners which further help to reduce heat build-up caused by sharp corners.

Reception core 3 and transmit core 4 are supported in base unit 9 by a suspension 25, and are aligned by the combination of holder 5 and elastomeric wire guide 6. Suspension 25 includes two lower insulator members 27 and 28 advantageously formed with a plurality of tabs 29 for positioning the cores. The insulator members 27 and 28 may be made of any appropriate dielectric material, for example, thermoplastic material such as Lexan® or Teflon®. Holder member 5, as well as all other elements of the housing, may also be made of the same thermoplastic material as members 27 and 28, unless otherwise specified herein. In order to ensure that lower cores 3 and 4 and upper cores 21 and 22 mate properly, without an air gap, when base unit 9 is assembled to upper housing member 2, core insulator members 27 and 28 are supported by metal springs 30 attached to the base by suitable pegs or other attachment means (not shown), using brazing, soldering, or similar methods, if necessary, and to the dielectric members via projections, though of course the details of the attachment may be varied by those skilled in the art. The use of a metallic coil spring suspension provides significant advantages in that elastomeric suspension systems are subject to relatively rapid deterioration with age, and especially to setting of the elastomeric material. Setting is not a problem with metallic springs 30 made of, for example, stainless steel or a similar resilient metallic material.

Holder 5 includes a stamped and formed recessed portion 32 shaped to receive elastomeric wire guide 6, the recess including openings 33 and 34 for accommodating core receiving projections 35 on guide 6, and a cover unit latching and alignment opening 36 whose function will be described in connection with the description of latch 7. Recessed portion 32 also includes extensions 37 for receiving strain relief portions of guide 6, and for seating within corresponding recesses 38 in lower housing member 1.

Elastomeric wire guide 6 is provided with openings 39 and 40 for receiving cores 3 and 4, the openings being divided by support members 41 into subopenings shaped to support the individual wires of cable 11 and to accommodate the individual legs of lower cores 3 and 4, thereby limiting the movement of the cores to the single degree of freedom allowed by the suspension. Advantageously, the portion of openings 39 and 40 located above supports 41 is not subdivided, permitting precise alignment of the upper and lower cores and cable wires without any material actually located between the cores and the wires, thus minimizing the dielectric constant of the signal coupling. Slots 42 are provided to position the wires of an untwisted section of the cable relative to the core, while slot 43 provides an exit for the cable through strain relief and support extensions 44, which prevents the alignment of the wires relative to the cores from being affected by tension on the cable. In an especially preferred embodiment, elastomeric wire guide 6 has resilient wire retention features for permitting snapping of the wires into slots 42 and 43 while retaining the bus wires in locked relationship with the completed base unit.

The advantages of providing tapered cores is evident from the shape of the wire guide slots 42, which accommodates an untwisted portion of the cable while minimizing the amount of cable which must be untwisted. Because the cores are tapered, i.e., provided with surfaces oriented at non-zero angles relative to each other adjacent the wires, in order to follow the natural shape of the untwisted cable, coupling between the wires of the cable and the cores is maximized. Furthermore, the positioning of the slots, and especially of support members 41, is such that the wires are approximately vertically centered in respect to the upper and lower cores, improving the sensitivity of the core when reading and further reducing the driving current requirements for writing. Thus, elastomeric insert 6 is designed to provide the advantages of optimum coupling between the cores and the cable wires, as well as to ease assembly of the wires to the coupler, and also to provide an effective wire strain relief. On the other hand, the strain relief function could also be provided by separate rubber strain relief grommets.

Aligned with opening 36 in wire guide holder 5 is a locking mechanism formed of an outer cylindrical member 45 and an inner receptacle 46 resiliently supported in member 45 for receiving a conventional quarter turn latch 47 mounted in upper housing member 2. Outer cylindrical member 45 both supports receptacle 46 and also accommodates a boss 48 provided on an upper half shielding plate 49, in order to align the upper half of the coupler with the base unit 9 during assembly. Thus, the interior diameter of member 45 should be approximately the same as the diameter of opening 36. Resilient support for member 46 within member 45 is necessary to ensure that there is no air space between the upper and lower housing members 1 and 2 when they are mated. It will, of course, be appreciated by those skilled in the art that numerous latching mechanisms other than the illustrated quarter turn latch may be substituted within the scope of the invention.

Figure 4A:
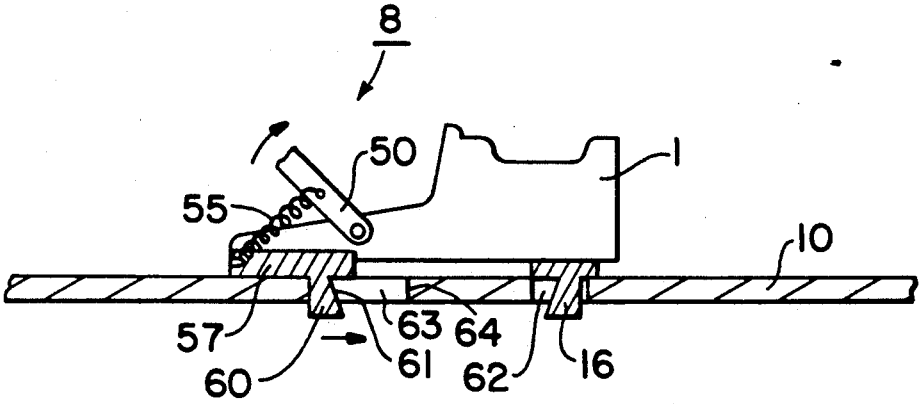
FIG. 4*a* is a cross-sectional side view illustrating the mounting arrangement for the preferred coupler arrangement of FIG. 1 in an unlocked position.
Figure 4B:
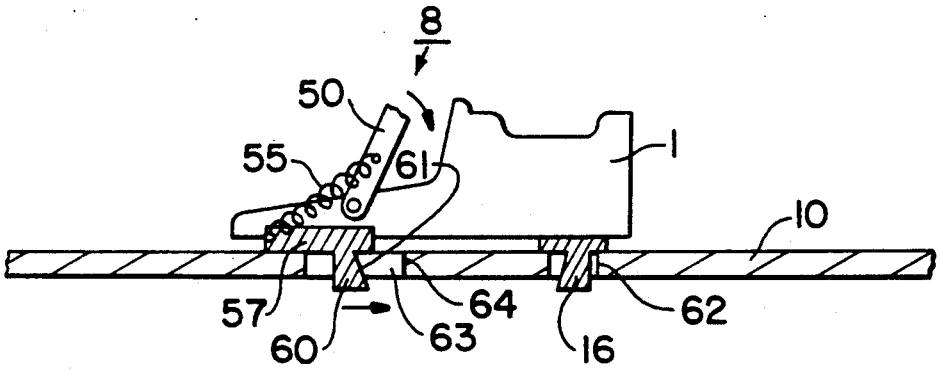
FIG. 4*b* is a cross-sectional side view illustrating the mounting arrangement for the preferred coupler arrangement of FIG. 1 in an intermediate position.
Figure 4C:
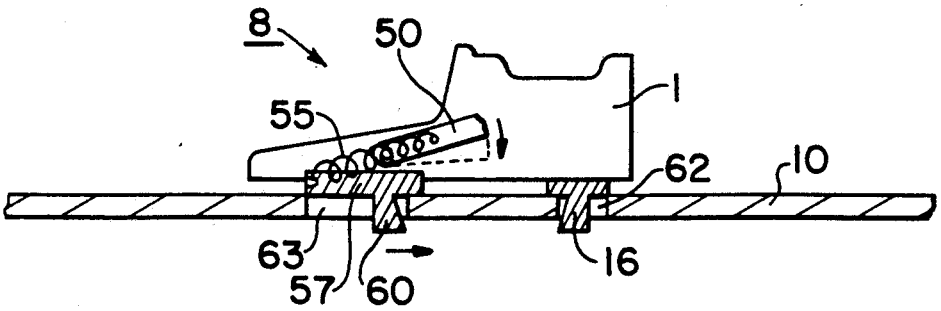
FIG. 4*c* is a cross-sectional side view illustrating the mounting arrangement for the preferred coupler arrangement of FIG. 1 in a maximum coil spring extension position.
Figure 5:
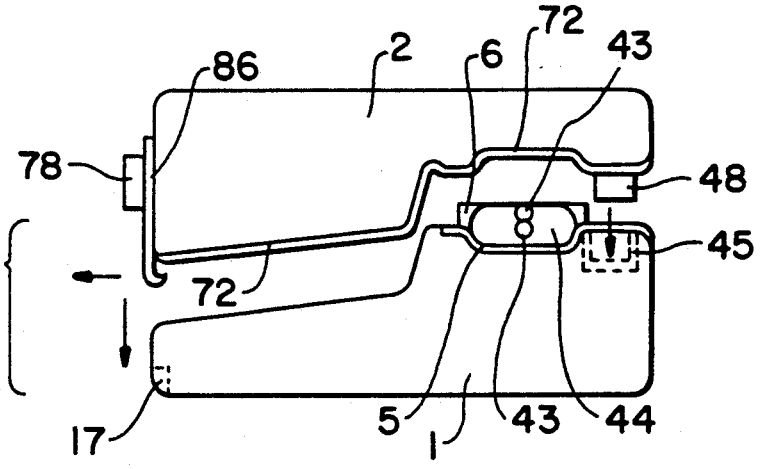
FIG. 5 is a schematic diagram of the manner in which the preferred coupler is assembled.

The final element which completes base unit 9 is the mounting mechanism, 8, whose operation is illustrated in FIG. 4. Mounting mechanism 8 includes a U-shaped lever handle 50 having arms 51 pivotally connected to lower housing member 1 by pivots 52 which are mounted in apertures 12 and openings 53 in the arms 51 of handle 50. Also provided in arms 51 are openings 54 to which first ends of overcenter coil springs 55 are connected by members 56 in a manner which permits coil springs 55 to pivot relative to handle 50. The second ends of coil springs 55 are attached to a sliding foot member 57 formed with arms 58 for securing the sliding foot member in slot 13. For example, coil springs 55 may be hooked onto extensions 58 of sliding foot member 57. At the base of sliding foot member 57 is a foot 60 having a tapered leading edge 61.

The panel or bulkhead to which the base unit is to be secured is provided with two openings 62 for receiving foot members 16 and an opening 63 for receiving foot member 60. In order to mount the base unit on the panel surface, foot member 16 is inserted into openings 62 and foot member 60 is inserted into opening 63 in a withdrawn or unlocking position shown in FIG. 4. Handle 50 is then manually pivoted to move slide 57 along the slot until leading edge 61 of foot 60 reaches a locking position, shown in solid line, in which it engages end portion 64 of opening 63. The user continues to pivot handle 50 until it can no longer be pivoted. Because of the arrangement of openings 54 above the pivot point, handle 50 forms an overcenter latching mechanism. Therefore, when handle 50 is in the locking position, coil spring 55 serves to retain foot 60 against edge 64. The tapers of the foot members 16 and 60 serve to center the device within the slots on the panel and takes up tolerances in manufacture. In order to release the mounting mechanism, handle 50 is simply pivoted in the opposite direction causing sliding foot to disengage from edge 64, until handle 50 passes the overcenter point of maximum extension of coil springs 55, causing the sliding foot member 57 to be withdrawn to its unlocking position.

In a less convenient, but nevertheless operable variation of the above mounting mechanism, the sliding foot member may be biased in the locking direction by a pair of coil springs provided in a groove in housing member 1 and the sliding foot mechanism may be secured in place by a set screw or similar locking arrangement after the base unit has been mounted on the panel or mounting surface. This variation is most suitable for a coupler in which the housing members are made of a thermoplastic, rather than stamped metal, material into which the necessary groove can be molded.

Upper housing member 2 is formed with a boss 65. Boss 65 includes an opening 66 for receiving quarter turn latch 47, and a bearing sleeve 67. Also included in upper housing member 2 is an upper E-core support section 68 and a connector mounting opening 69. E-cores 21 and 22 may optionally be resiliently supported, although such an additional resilient support will not ordinarily be necessary in view of the effectiveness of lower suspension 25. E-cores 21 and 22 are secured to a thermoplastic member 70' which is further secured to section 68 of upper housing 2, thereby insulating the magnetic cores. Alignment of E-cores 21 and 22 is provided by a thermoplastic member 70 which includes raised portions 71 for insertion into corresponding openings in a metal shielding plate 72. Plate 72 includes raised portion 73 for supporting member 70, circuit board 74. Member 70 therefore isolates the cores from metal plate 72 and plate 72 from circuit board 74.

Circuit board 74 carries a plurality of electrical components 75; including a read signal amplifier and a write signal driver circuit, both of which are completely shielded by a combination of metal plate 72 and upper housing member 2. Circuit board 74 also includes trapezoidal openings for accommodating E-cores 21 and 22, and windings 77 encircling the openings 76. The windings 77 consist of printed circuit coils for the E-cores in known manner.

Figure 6:
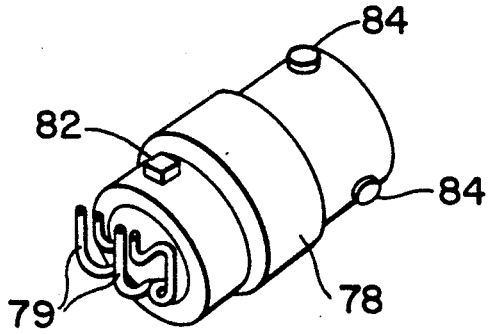
FIG. 6 is a perspective view of a connector suitable for use in the coupler of FIGS. 1–5.

Read and write signals are sent to and from the coupler via a conventional cylindrical connector 78 having PCB tails 79 for insertion into corresponding notches provided in the circuit board, and extending through opening 69. It will be appreciated by those skilled in the art that other types of connectors may be substituted, including D-sub connectors and connectors utilizing surface mount rather than PCB tail supporting arrangements. However, the preferred manner in which connector 78 is mounted to the circuit board is advantageous in that soldering of PCB tails 79 into notches in the circuit board 74 provides support for the component carrying end 80 of the circuit board within upper housing member 2 without the need for additional mounting arrangements, because the coil carrying end 81 of circuit board 74 is supported by metal plate 72. It will, however, also be appreciated that various projections or the like may additionally be provided on housing member 2 to provide further support for the circuit board, and also to support shielding and circuit board mounting plate 72, which itself is positioned in respect to upper housing member 2 by boss 65 and by fitting against the lower rim A of upper housing 2. Connector 78, as illustrated in FIG. 6, also includes a key 82 for cooperation with a notch 83 in opening 69 to axially align the connector, and bayonet projections 84 for cooperating with bayonet slots in a corresponding connector (not shown) to which connector 78 is to be mated. Once metal plate 72 is in place, thereby completely shielding the read/write circuitry and coils, the upper housing unit thus formed may be potted using conventional potting methods and materials.

Metal plate 72 further includes a cylindrical boss 48 depending therefrom which cooperates, as described above, with opening 36 in holder 5 and with outer cylindrical member 45 of latching mechanism 7 to align the upper housing half with base unit 9. In addition, a lock washer 85 may be provided to loosely hold latch 47 in opening 66.

The circuit board receiving end of housing member 2 is secured to the base unit 9 by a resilient latching member 86 having a distal latching projection 87 which engages an upper edge of slot 17 to hold the upper housing member in place. Because of the resilience of member 86, upper housing member 2 can be snapped into base unit 9 by a single vertical motion, as shown in FIG. 6, after the wires of cable 11 have been untwisted and snapped into slots 42 and 43 of elastomeric wire guide 6. As cylindrical boss 48 enters opening 36 and outer cylindrical member 45, engagement between projection 87 and lower housing member 1 causes latching member 86 to deflect outwardly, permitting the projection to clear the housing. When projection 87 reaches slot 17, it enters the slot under the influence of the restoring force provided by resilient latching member 8, thereby completing assembly of the coupler.

Having thus described a preferred embodiment of the invention, however, the inventors recognize that numerous variations of the preferred embodiment will undoubtedly occur to those skilled in the art, and intend that the invention be defined to include all such variations. For example, latching member 86 may be provided on the lower housing member 1, and slot 17 may be provided in upper housing member 2. In addition, there may be two latching members located in the sides of housing member 1 (or 2) and arranged to straddle the respective second housing member 2 (or 1) and engage corresponding slots therein. Still further, the cable with which the coupler is to be used need not be an unshielded, twisted pair cable or a closed loop data bus. Consequently, it is intended that the invention not be limited to the preferred embodiment described herein and illustrated in the drawings but rather that it be limited solely by the appended claims.

We claim:

1. A non-invasive coupler for a cable of the type including at least one signal wire, comprising:

a lower magnetic core half;

a base unit comprising means for supporting the lower magnetic core half;

an upper housing member;

upper core support means for supporting an upper magnetic core half in the upper housing member;

a wire guide member comprising means for positioning a wire with respect to said core halves and for aligning said core halves with respect to each other to form a magnetic core structure;

core structure winding means including windings for encircling a portion of said upper magnetic core half to cause electrical signals to be transmitted between said windings and said wire via said magnetic core structure;

an electrical connector mounted in said upper housing;

circuit means for electrically connecting said windings and said connector; and upper housing alignment and attachment means for aligning said upper housing with respect to said base unit and for releasably attaching said upper housing to said base unit, wherein said wire guide member comprises an elastomeric member having means including at least one slot for resiliently retaining said wire in a predetermined position and means including at least one opening, surfaces of said opening engaging each of said core halves, for resiliently retaining said core halves in a predetermined position when said upper housing is attached to said base unit.

2. A coupler as claimed in claim 1, wherein said elastomeric member further comprises an integral strain relief extension having means including at least one strain relief slot for preventing tension on said cable from affecting a position of said wire in said at least one slot.

3. A coupler as claimed in claim 1, wherein said at least one slot comprises two slots oriented at a non-zero angle with respect to each other, and wherein surfaces of said core halves adjacent said two slots are also oriented at approximately said non-zero angle to enable said surfaces to follow a curvature of wire positioned in said two slots.

4. A coupler as claimed in claim 3, wherein said core halves have trapezoidal cross-sections.

5. A coupler as claimed in claim 1, further comprising a second lower core half and said at least one slot includes a second slot arranged to position a second signal wire with respect to the second lower core half, and wherein said first magnetic core structure forms a read transformer and said second lower core half together with a second upper core half forms a write transformer.

6. A coupler as claimed in claim 5, wherein said cable is an unshielded twisted pair cable, and said two slots are arranged at a non-zero angle relative to each other.

7. A coupler as claimed in claim 6, wherein said core halves have an E-shape including a base and three legs extending therefrom, and wherein two of said legs have trapezoidal cross-sections such that surfaces of said legs adjacent said wires are parallel to respective ones of said wires, and wherein all corners of said core halves are rounded to prevent heat build-up.

8. A coupler as claimed in claim 7, wherein the legs of one of said lower core halves have a cross-sectional area which is twice as large as that of the legs of the second one of said lower core halves in order to reduce the amount of write current required in said winding to induce a corresponding write current in said second signal wire.

9. A coupler as claimed in claim 1, further comprising a second core half, each of said core halves having an E-shape including a base and three legs extending therefrom, and wherein said winding includes a write winding and a read winding.

10. A coupler as claimed in claim 9, wherein two of said legs are outer legs having trapezoidal cross-sections such that three sides of one of said outer legs are parallel to respective sides of a second of said outer legs, and such that a fourth side of one of said outer legs is at a non-zero angle relative to a corresponding fourth side of the second of outer legs, a third of said legs being located between said two outer legs and having two mutually parallel sides and two mutually nonparallel sides, the mutually nonparallel sides being parallel to the respective fourth sides of said outer legs.

11. A coupler as claimed in claim 1, wherein said core is tapered to form to the geometry of said wire in said at least one slot.

12. A coupler as claimed in claim 1, further comprising a second lower core half, said second lower core half having a cross-sectional area which is twice as large as that of the first lower core half in order to reduce the amount of write current required in said winding to induce a corresponding write current in said wire.

13. A coupler as claimed in claim 1, wherein said means for supporting the lower core half comprises an all metal coil spring suspension, including a coil spring and insulating means for insulating the lower core half from the coil spring.

14. A coupler as claimed in claim 13, wherein said insulation means comprises a dielectric member attached between the coil spring and the lower core half.

15. A coupler as claimed in claim 13, wherein said coil spring suspension comprises a plurality of metal coil springs.

16. A coupler as claimed in claim 13, further comprising a second dielectric member attached to said base unit and including means defining a recess for positioning said elastomeric member in said base unit, thereby limiting movement of said lower core half to a single degree of freedom, said suspension causing said lower core half to move towards said upper core half and eliminate any air gap between said core halves while said elastomeric member holds said core halves in alignment with each other.

17. A coupler as claimed in claim 1, further comprising a holder member attached to said base unit and including means defining a recess for positioning said elastomeric member in said base unit.

18. A coupler as claimed in claim 17, wherein said holder member further comprises means defining an opening in said holder member for receiving a boss depending from a metal plate secured to said upper housing, said boss and opening cooperating to align said upper housing with said base unit.

19. A coupler as claimed in claim 18, wherein said base unit further comprises a quarter-turn latch receptacle and said boss includes an aperture in which is positioned a quarter-turn latch arranged to be received in said receptacle when said upper housing member is assembled to said base unit.

20. A coupler as claimed in claim 1, further comprising mounting means for releasably mounting said base unit on a surface which includes at least two openings.

21. A coupler as claimed in claim 20, wherein said mounting means comprises at least one foot fixed to said base unit, a sliding foot member, and means for slidably supporting said slidable foot member on said base unit, said foot being arranged to be received in one of said openings in said surface and a portion of said sliding foot member being arranged to be received in another of said openings in said surface.

22. A coupler as claimed in claim 21, wherein said means for slidably supporting said slidable foot member on said base unit comprises a slot in said base unit and projections on said foot member for engaging edges of said slot in said base unit.

23. A coupler as claimed in claim 21, wherein said mounting means, further comprises means including a handle and an overcenter spring mechanism for biasing said locking member towards a locking position when said handle is in a respective locking position.

24. A coupler as claimed in claim 23, wherein said handle is a lever pivotably mounted on said base unit.

25. A coupler as claimed in claim 24, wherein said overcenter spring mechanism comprises a coil spring connected between said sliding foot member and an attachment point on said handle, said attachment point being located a predetermined distance from a point about which said handle pivots such that a length of said coil spring is maximum when said handle is at a position intermediate said locking and unlocking positions of said handle.

26. A coupler as claimed in claim 25, further comprising a second coil spring connected between said sliding foot member and said handle.

27. A coupler as claimed in claim 21, wherein said mounting means further comprises a second foot fixed to said base unit.

28. A coupler as claimed in claim 21, wherein said foot and a second foot depending from said sliding foot member are contoured to center said base unit with respect to said openings in said surface.

29. A coupler as claimed in claim 1, further comprising a resilient latching member extending from an end of one of said upper housing member and said base unit, and a recess in the other of said upper housing member and said base unit for receiving a projection on said latching member, whereby said upper housing member and base unit may be mated in a single linear motion, said latching member flexing during mating to permit said projection to clear a surface of said base unit before said projection enters said recess to hold said upper housing in engagement with said base unit.

30. A coupler as claimed in claim 29, wherein said latching member depends from said upper housing member and said recess is located in said base unit.

31. A coupler as claimed in claim 29, wherein said circuit means comprises traces and electrical components on a printed circuit board mounted in said upper housing member.

32. A coupler as claimed in claim 31, wherein said windings comprise printed circuit windings on said printed circuit board.

33. A coupler as claimed in claim 31, wherein said connector comprises PCB tails connected to notches in said printed circuit board.

34. A coupler as claimed in claim 31, wherein said upper housing is made of a conductive metal, and further comprising a conductive metal plate secured to said upper housing, said circuit board being mounted on said metal plate and said metal plate and upper housing together enclosing said circuit means to electromagnetically shield said circuit means.

35. A coupler as claimed in claim 34, wherein said connector comprises PCB tails mounted in notches in said circuit board, and said circuit board is supported by said metal plate and said PCB tails.

36. A coupler as claimed in claim 34, wherein said base unit comprises a metal lower housing member, said upper and lower housings together enclosing said coupler when said upper housing is mated to said base unit.

37. A coupler as claimed in claim 34, further comprising an insulating member mounted between said metal plate and said circuit board, said upper core half extending through at least one opening in said circuit board, said insulating member, and said metal plate.

38. A coupler as claimed in claim 34, wherein said boss depending from said metal plate is arranged to enter an opening in said means for supporting the lower core half, to align said upper housing with said base unit.

39. A coupler as claimed in claim 1, wherein said upper housing member is made of a conductive metal, and said base unit includes a lower housing member also made of a conductive metal.

40. A coupler as claimed in claim 1, wherein said upper magnet support means comprises a dielectric insulating member fixedly connected between said upper housing and said upper core half.

41. A coupler as claimed in claim 1, wherein said base unit includes a lower housing and all edges and corners on said upper and lower housings are rounded to maximize heat dissipation from said coupler.

42. A non-invasive coupler for a cable of the type including at least one signal wire, comprising:

a lower magnetic core half;

a base unit comprising means for supporting the lower magnetic core half;

an upper housing member;

upper core support means for supporting an upper magnetic core half in the upper housing member;

a wire guide member comprising means for positioning a wire with respect to said core halves and for aligning said core halves with respect to each other to form a magnetic core structure;

core structure winding means including windings for encircling a portion of said upper magnetic core half to cause electrical signals to be transmitted between said windings and said wire via said magnetic core structure;

an electrical connector mounted in said upper housing;

circuit means for electrically connecting said windings and said connector; and upper housing alignment and attachment means for aligning said upper housing with respect to said base unit and for releasably attaching said upper housing to said base unit, and further comprising a second lower core half and means for supporting the second lower core half, said wire guide member comprising means including two slots for positioning a first signal wire and a second signal wire with respect to the lower and upper core halves, and wherein said magnetic core structure forms a read transformer and said second upper and lower core halves together form a write transformer.

43. A coupler as claimed in claim 42, wherein said cable is an unshielded twisted pair cable, and said two slots are arranged at a non-zero angle relative to each other.

44. A coupler as claimed in claim 43, wherein said core halves each have an E-shape including a base and three legs extending therefrom, and wherein said legs have trapezoidal cross-sections such that surfaces of said legs adjacent said wires are parallel to respective ones of said wires.

45. A coupler as claimed in claim 44, wherein the legs of one of said lower core halves have a cross-sectional area which is twice as large as that of the legs of the second one of said lower core halves in order to reduce the amount of write current required in said winding to induce a corresponding write current in said second signal wire.

46. A coupler as claimed in claim 42, wherein said core is tapered to conform to the geometry of said wires in said two slots.

47. A coupler as claimed in claim 42, wherein said means for supporting the lower core halves comprises an all metal coil spring suspension, including a coil spring and insulating means for insulating the lower core halves from the coil spring.

48. A non-invasive coupler for a cable of the type including at least one signal wire; comprising:

a lower magnetic core half;

a base unit comprising means for supporting the lower magnetic core half;

an upper housing member;

upper core support means for supporting an upper magnetic core half in the upper housing member;

a wire guide member comprising means for positioning a wire with respect to said core halves and for aligning said core halves with respect to each other to form a magnetic core structure;

core structure winding means including windings for encircling a portion of said upper magnetic core half to cause electrical signals to be transmitted between said windings and said wire via said magnetic core structure;

an electrical connector mounted in said upper housing;

circuit means for electrically connecting said windings and said connector; and upper housing alignment and attachment means for aligning said upper housing with respect to said base unit and for releasably attaching said upper housing to said base unit, and further comprising mounting means for releasably mounting said base unit on a surface which includes at least two openings.

49. A coupler as claimed in claim 48, wherein said mounting means comprises at least one foot fixed to said base unit, a sliding foot member, and means for slidably supporting said slidable foot member on said base unit, said foot being arranged to be received in one of said openings in said surface, and a portion of said sliding foot member being arranged to be received in another of said openings in said surface.

50. A coupler as claimed in claim 49, wherein said means for slidably supporting said slidable foot member on said base unit comprises an opening in said base unit and a projection on said foot member for engaging edges of said opening in said base unit.

51. A coupler as claimed in claim 50, wherein said mounting means further comprises means including a handle and an overcenter spring mechanism for biasing said locking member towards a locking position when said handle is in a respective locking position.

52. A coupler as claimed in claim 50, wherein said handle is a lever pivotably mounted on said base unit.

53. A coupler as claimed in claim 52, wherein said overcenter spring mechanism comprises a coil spring connected between said sliding foot member and an attachment point on said handle, said attachment point being located a predetermined distance from a point about which said handle pivots such that a length of said coil spring is maximum when said handle is at a position intermediate said locking and unlocking positions of said handle.

54. A coupler as claimed in claim 53, further comprising a second coil spring connected between said sliding foot member and said handle.

55. A coupler as claimed in claim 50, wherein said mounting means further comprises a second foot fixed to said base unit.

56. A coupler as claimed in claim 50, wherein said foot and a second foot depending from said sliding foot member are contoured to center said base unit with respect to said openings in said surface.

57. A non-invasive coupler for a cable of the type including at least one signal wire, comprising:

a lower magnetic core half;

a base unit comprising means for supporting the lower magnetic core half;

an upper housing member;

upper core support means for supporting an upper magnetic core half in the upper housing member;

a wire guide member comprising means for positioning a wire with respect to said core halves and for aligning said care halves with respect to each other to form a magnetic core structure;

core structure winding means including windings for encircling a portion of said upper magnetic core half to cause electrical signals to be transmitted between said windings and said wire via said magnetic core structure;

an electrical connector mounted in said upper housing;

circuit means for electrically connecting said windings and said connector; and upper housing alignment and attachment means for aligning said upper housing with respect to said base unit and for releasably attaching said upper housing to said base unit, wherein said core is tapered to conform to the geometry of said wire in said wire guide member.

58. A coupler as claimed in claim 57, wherein two of said legs are outer legs having trapezoidal cross-sections such that three sides of one of said outer legs are parallel to respective sides of a second of said outer legs, and such that a fourth side of one of said outer legs is at a non-zero angle relative to a corresponding fourth side of the second of said outer legs, a third of said legs being located between said two outer legs and having two mutually parallel sides and two mutually nonparallel sides, the mutually nonparallel sides being parallel to the respective fourth sides of said outer legs.

59. A coupler as claimed in claim 57, wherein said means for supporting the lower core half comprises an all metal coil spring suspension, including a coil spring and insulating means for insulating the lower core half from the coil spring.

60. A non-invasive coupler for a cable of the type including at least one signal wire, comprising:

a lower magnetic core half;

a base unit comprising means for supporting the lower magnetic core half;

an upper housing member;

upper core support means for supporting an upper magnetic core half in the upper housing member;

a wire guide member comprising means for positioning a wire with respect to said core halves and for aligning said core halves with respect to each other to form a magnetic core structure;

core structure winding means including windings for encircling a portion of said upper magnetic core half to cause electrical signals to be transmitted between said windings and said wire via said magnetic core structure;

an electrical connector mounted in said upper housing;

circuit means for electrically connecting said windings and said connector; and upper housing alignment and attachment means for aligning said upper housing with respect to said base unit and for releasably attaching said upper housing to said base unit, further comprising a second lower core half, said second lower core half having a cross-sectional area which is twice as large as that of the first lower core half in order to reduce the amount of write current required in said winding to induce a corresponding write current in said wire.

61. A non-invasive coupler for a cable of the type including at least one signal wire, comprising:

a lower magnetic core half;

a base unit comprising means for supporting the lower magnetic core half;

an upper housing member;

upper core support means for supporting an upper magnetic core half in the upper housing member;

a wire guide member comprising means for positioning a wire with respect to said core halves and for aligning said core halves with respect to each other to form a magnetic core structure;

core structure winding means including windings for encircling a portion of said upper magnetic core half to cause electrical signals to be transmitted between said windings and said wire via said magnetic core structure;

an electrical connector mounted in said upper housing;

circuit means for electrically connecting said windings and said connector; and upper housing alignment and attachment means for aligning said upper housing with respect to said base unit and for releasably attaching said upper housing to said base unit, wherein said means for supporting the lower core half comprises an all metal coil spring suspension, including a coil spring and insulating means for insulating the lower core half from the coil spring.

62. A coupler as claimed in claim 61, wherein said insulation means comprises a dielectric member attached between the coil spring and the lower core half.

63. A coupler as claimed in claim 61, wherein said coil spring suspension comprises a plurality of metal coil springs.

64. A coupler as claimed in claim 61, further comprising a second holder member attached to said base unit and including means defining a recess for positioning said elastomeric member in said base unit, and thereby limiting movement of said lower core half to a single degree of freedom, said suspension causing said lower core half to move towards said upper core half and eliminate any air gap between said core halves while said elastomeric member holds said core halves in alignment with each other.

65. A coupler as claimed in claim 61, further comprising a holder member attached to said base unit and including means defining a recess for positioning said elastomeric member in said base unit.

66. A coupler as claimed in claim 65, wherein said holder member further comprises means defining an opening for receiving a boss depending from a metal plate secured to said upper housing, said boss and opening cooperating to align said upper housing with said base unit.

67. A coupler as claimed in claim 66, wherein said base unit further comprises a quarter-turn latch receptacle and said boss includes an aperture in which is positioned a quarter-turn latch arranged to be received in said receptacle when said upper housing member is assembled to said base unit.

68. A non-invasive coupler for a cable of the type including at least one signal wire, comprising:

a lower magnetic core half;

a base unit comprising means for supporting the lower magnetic core half;

an upper housing member;

upper core support means for supporting an upper magnetic core half in the upper housing member;

a wire guide member comprising means for positioning a wire with respect to said core halves and for aligning said core halves with respect to each other to form a magnetic core structure;

core structure winding means including windings for encircling a portion of said upper magnetic core half to cause electrical signals to be transmitted between said windings and said wire via said magnetic core structure;

an electrical connector mounted in a recess in said upper housing;

circuit means for electrically connecting said windings and said connector; and upper housing alignment and attachment means for aligning said upper housing with respect to said base unit and for releasably attaching said upper housing to said base unit, further comprising a resilient latching member extending from an end of one of said upper housing member and said base unit, and a recess in the other of said upper housing member and said base unit for receiving a projection on said latching member, whereby said upper housing member and base unit may be mated in a single linear motion, said latching member flexing during mating to permit said projection to clear a surface of said base unit before said projection enters said recess to hold said upper housing in engagement with said base unit.

69. A coupler as claimed in claim 68, wherein said latching member depends from said upper housing member and said recess is located in said base unit.

70. A coupler as claimed in claim 68, wherein said circuit means comprises traces and electrical components on a printed circuit board mounted in said upper housing member.

71. A coupler as claimed in claim 70, wherein said windings comprise printed circuit windings on said printed circuit board.

72. A coupler as claimed in claim 70, wherein said connector comprises PCB tails connected to notches in said printed circuit board.

73. A coupler as claimed in claim 70, wherein said upper housing is made of a conductive metal, and further comprising a conductive metal plate secured to said upper housing, said circuit board being mounted on said metal plate and said metal plate and upper housing together enclosing said circuit means to electromagnetically shield said circuit means.

74. A coupler as claimed in claim 73, wherein said connector comprises PCB tails mounted in notches in said circuit board, said circuit board being supported by said metal plate and said PCB tails.

75. A coupler as claimed in claim 73, wherein said base unit comprises a metal lower housing, said upper and lower housings together enclosing said coupler when said upper housing is mated to said base unit.

76. A coupler as claimed in claim 73, further comprising an insulating member mounted between said metal plate and said circuit board, said upper core half extending through at least one opening in said circuit board, said insulating member, and said metal plate.

77. A coupler as claimed in claim 73, wherein said boss depending from said metal plate is arranged to enter an opening in said means for supporting the lower core half to align said upper housing with said base unit.

78. A non-invasive coupler for a cable of the type including at least one signal wire, comprising:

a lower magnetic core half;

a base unit comprising means for supporting the lower magnetic core half;

an upper housing member;

upper core support means for supporting an upper magnetic core half in the upper housing member;

a wire guide member comprising means for positioning a wire with respect to said core halves and for aligning said core halves with respect to each other to form a magnetic core structure;

core structure winding means including windings for encircling a portion of said upper magnetic core half to cause electrical signals to be transmitted between said windings and said wire via said magnetic core structure;

an electrical connector mounted in said upper housing;

circuit means for electrically connecting said windings and said connector; and upper housing alignment and attachment means for aligning said upper housing with respect to said base unit and for releasably attaching said upper housing to said base unit, wherein said upper housing member is made of a conductive metal, and said base unit includes a lower housing member also made of a conductive metal.

79. A coupler as claimed in claim 78, further comprising a conductive metal plate secured to said upper housing, said circuit means comprising a circuit board mounted on said metal plate, and said metal plate and upper housing member together enclosing said circuit means to electromagnetically shield said circuit means.

80. A non-invasive coupler for a cable of the type including at least one signal wire, comprising:

a lower magnetic core half;

a base unit comprising means for supporting the lower magnetic core half;

an upper housing member;

upper core support means for supporting an upper magnetic core half in the upper housing member;

a wire guide member comprising means for positioning a wire with respect to said core halves and for aligning said core halves with respect to each other to form a magnetic core structure;

core structure winding means including windings for encircling a portion of said upper magnetic core half to cause electrical signals to be transmitted between said windings and said wire via said magnetic core structure;

an electrical connector mounted in said upper housing;

circuit means for electrically connecting said windings and said connector; and upper housing alignment and attachment means for aligning said upper housing with respect to said base unit and for releasably attaching said upper housing to said base unit, wherein said base unit includes a lower housing and all edges and corners on said upper and lower housings are rounded to maximize heat dissipation from said coupler.

* * * * *

US005241219C1

(12) EX PARTE REEXAMINATION CERTIFICATE (4843rd)

United States Patent

LeBaron et al.

(10) Number: US 5,241,219 C1

(45) Certificate Issued: Sep. 2, 2003

(54) CURRENT MODE COUPLER

(75) Inventors: James B. LeBaron, Sidney, NY (US); David O. Gallusser, Oneonta, NY (US); Brian R. Hackler, Oneonta, NY (US)

(73) Assignee: Amphenol Corporation, Wallingford, CT (US)

Reexamination Request:
No. 90/005,930, Feb. 16, 2001
No. 90/006,078, Aug. 10, 2001

Reexamination Certificate for:

| | |
|---|---|
| Patent No.: | **5,241,219** |
| Issued: | **Aug. 31, 1993** |
| Appl. No.: | **07/804,696** |
| Filed: | **Dec. 11, 1991** |

(51) Int. Cl.[7] ..... H01F 13/00

(52) U.S. Cl. ..... 307/104; 336/DIG. 2

(58) Field of Search ..... 307/104; 336/DIG. 2; 361/679, 728–730, 826–828, 600

(56) References Cited

U.S. PATENT DOCUMENTS

| | | | |
|---|---|---|---|
| 3,836,885 | A | 9/1974 | Larsile |
| 4,264,827 | A | 4/1981 | Herzog |
| 4,758,179 | A | 7/1988 | Klein et al. |
| 4,789,847 | A | 12/1988 | Sakamoto et al. |
| 4,904,879 | A | 2/1990 | Rudy, Jr. et al. |
| 5,081,648 | A | 1/1992 | Herzog |
| 5,105,095 | A | 4/1992 | Rudy, Jr. et al. |
| 5,112,247 | A | 5/1992 | Rudy, Jr. et al. |
| 5,128,835 | A | 7/1992 | Rudy, Jr. et al. |
| 5,192,832 | A | 3/1993 | Rudy, Jr. et al. |

FOREIGN PATENT DOCUMENTS

| | | |
|---|---|---|
| DE | A03706953 | 9/1987 |

OTHER PUBLICATIONS

SCI Proposal No. P87–242–050 Published by SCI (Jul. 8, 1987).

"Boeing Action Item Report" Published by Boeing (Aug. 2, 1989).

Drawing "C–M Coupler" By G.D. Morant, Boeing, (Spring 1990).

*Primary Examiner*—Albert W Paladini

(57) ABSTRACT

A current mode coupler for an unshielded twisted-pair cable includes an elastomeric signal wire and E-core positioning member with integral strain relief, tapered E-cores for improved coupling to the wires, a write signal core which is twice the size of the read signal core, an all metal core suspension, an overcenter spring biased mounting arrangement, a metal enclosure for improved shielding, a resilient latch which avoids the need for pivoting of an upper housing member relative to the base unit during assembly, and contoured edges and corners for reducing heat accumulation.

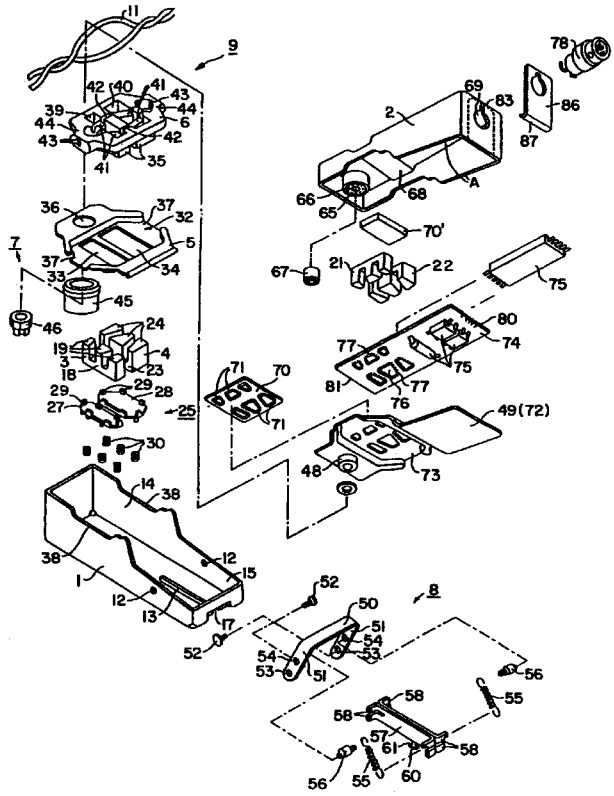

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–80 is confirmed.

* * * * *